United States Patent [19]

Rheinländer et al.

[11] 3,985,549

[45] Oct. 12, 1976

[54] PROCESS FOR CONTINUOUSLY REFINING MOLTEN METALS

[75] Inventors: Paul Rheinländer; Gustav Mahn, both of Wolfenbuttel; Klaus Berner, Salzgitter-Lebensstedt, all of Germany; Klaus Schulz, deceased, late of Wolfenbuttel, Germany; by Ingrid Ruhland, legal representative, Braunschweig, Germany

[73] Assignee: Stahlwerke Peine-Salzgitter Aktiengesellschaft, Peine, Germany

[22] Filed: May 7, 1975

[21] Appl. No.: 575,174

Related U.S. Application Data

[63] Continuation-in-part of Ser. No. 335,812, Feb. 26, 1973, which is a continuation of Ser. Nos. 46,687, June 16, 1970, abandoned, and Ser. No. 825,643, May 19, 1969.

[30] Foreign Application Priority Data

| | | |
|---|---|---|
| May 18, 1968 | Germany | 1758364 |
| June 22, 1968 | Germany | 1758357 |
| June 18, 1969 | Germany | 1930746 |

[52] U.S. Cl. ..... 75/52; 75/46; 75/60; 266/201

[51] Int. Cl.[2] ..... C21C 7/00

[58] Field of Search ..... 75/30, 41, 60, 52, 46; 266/34

[56] References Cited

UNITED STATES PATENTS

| | | | |
|---|---|---|---|
| 2,707,675 | 5/1955 | Graef | 75/52 |
| 2,918,365 | 12/1959 | Kanamori | 75/41 |
| 3,275,432 | 9/1966 | Alexandrovsky | 75/52 |
| 3,565,605 | 2/1971 | Vayssiere | 75/52 |
| 3,617,257 | 11/1971 | Rouang | 75/52 |
| 3,692,290 | 9/1972 | Hager | 75/52 |

*Primary Examiner*—Peter D. Rosenberg
*Attorney, Agent, or Firm*—Toren, McGeady and Stanger

[57] ABSTRACT

The disclosed process of continuously refining molten metal is carried out in a refining apparatus having communicating first and second refining stage spaces. Refining gas, such as oxygen, is blown into the molten metal in the presence of a slag layer on the molten metal. The molten metal and the slag are conveyed as two separate non-intermingled streams through the refining stage spaces, as distinguished from a slag-metal emulsion. The slag in the second refining stage space is caused continuously to flow back into the first refining stage space to form a slag layer on the molten metal in the first refining stage space. Refining gas is blown into the molten metal in the first refining stage space below said slag layer, and the molten metal is conveyed from said first refining stage space to said second refining stage space while preventing the flow of slag from said first refining stage space to said second refining stage space. Refining gas is blown onto said molten metal in said second refining stage space in the presence of slag so that a slag layer on the molten metal in said second refining stage space is formed. The molten metal and the slag are separated from each other after the molten metal has passed through said second refining stage space.

19 Claims, 10 Drawing Figures

INVENTORS
PAUL RHEINLÄNDER
GUSTAV HAHN
KLAUS SCHULZ
KLAUS BERNER
By: [illegible]
ATTORNEYS INVENTORS
PAUL RHEINLÄNDER
GUSTAV MAHN
KLAUS SCHULZ
KLAUS BERNER
By: McGlew & Toren
ATTORNEYS INVENTORS
PAUL RHEINLÄNDER
GUSTAV MAHN
KLAUS SCHULZ
KLAUS BERNER
By: McGlew & Toren
ATTORNEYS

PROCESS FOR CONTINUOUSLY REFINING MOLTEN METALS

CROSS-REFERENCE TO PRIOR APPLICATIONS

This is a continuation-in-part of co-pending application Ser. No. 335,812 filed Feb. 26, 1973 which in turn was a continuation of Ser. No. 46,687 filed 6/16/1970, now abandoned, as well as of co-pending application Ser. No. 825,643 filed May 19, 1969.

FIELD OF INVENTION

This invention relates to processes and apparatus for continuously refining metals, for example, pig iron to make steel, in several stages by blowing downwards onto the surface of the melt a refining gas containing oxygen together with or in the presence of slag forming substances.

SUMMARY OF THE INVENTION

Many attempts have been made to replace batch refining processes, for example, the well known Siemens-Martin, Thomas, LD, or LDAC processes by a continuous process, because batch operation involves several serious disadvantages. Between the successive batch operations a pause occurs during which the steel and the slag are tapped off and the apparatus is recharged. During these pauses no metallurgical reactions take place, and the refining vessels are subjected to considerable stresses due to the large temperature reductions. These heat losses, together with the fact that it has not hitherto been possible to control batch operations precisely on a programme basis, have caused considerable variations in product analysis and quality between successive batches.

Continuous refining processes are known in which the raw molten metal is introduced into a refining zone where a jet of refining gas containing additive substances is blown into the melt very energetically, producing a metal-slag emulsion. The emulsion spills continuously over the top of a separating wall or weir into a settling vessel where the metal separates from the slag. However, this process has the disadvantage that the metal and slag are conveyed by the emulsion, which is produced by reaction between the metal and the refining gas containing the slag forming substances. This known process is very sensitive to changes in any of the operating conditions, due to the relationship between the rate of flow of the molten metal over the separating weir, and the reaction time. Furthermore, there is a feed back of the slag to below the surface of the emulsion in the reactor vessel upstream of the separating weir and it is impossible to prevent this slag from circulating back into the settling vessel.

In another known process for continuously making steel, pig iron is refined in several vessels arranged in series. The slag flows in countercurrent to the molten iron by gravity, from one vessel to the next, whereas the iron is conveyed from vessel to vessel by pumps. This process is extremely costly in apparatus and the pumps consume a great deal of power. A further disadvantage is that the final slag, which contains a high concentration of ferrous oxide, is not utilized, this slag being tapped off into a slag pan from the first vessel which receives the raw pig iron.

One object of the present invention is to remove the disadvantages of the usual refining processes, and in particular to provide a continuous refining process in which the flow of material takes place independently of the metallurgical reactions, so that the flow and the reactions can be controlled independently.

To this end, according to one aspect of this invention, in a process for continuously refining molten metal in which the molten metal with slag on its surface passes through at least two refining stage vessels or spaces in which refining gas together with slag forming substances are blown downwards on to the surface of the metal to form the slag, the slag and/or the metal in passing from one stage vessel to another is introduced into the other vessel above the surface of the liquid in that vessel.

When the slag, for example, a lime-base slag, is fed back from one refining stage vessel to the previous one, the slag is introduced above the surface of the melt in the previous vessel. In this case the metal, for example, molten pig iron, can be introduced into the individual refining stage vessels below the surface of the melt, the metal being conveyed continuously between the individual refining stages by utilizing the ferrostatic pressure. Alternatively, however, if desired the metal can be conveyed by a power-operated conveying device, for example, a mechanical or electromagnetic conveyor, in which case the metal is preferably introduced above the surface of the melt in the vessel to which it is conveyed. By proceeding in this way, return flow of metal or slag is prevented and the flow of material can be controlled independently of the metallurgical reactions.

The final slag from the last refining stage vessel, being still capable of reacting, it preferably fed back into the first refining stage vessel. The fact that the slag is introduced into the first stage vessel above the surface of the melt in the refining chamber of the vessel provides the further advantage that an intensive mixing of the molten metal with the slag by the refining gas results, so that the metallurgical reactions follow a particularly favorable course.

The process in accordance with the invention may suitably be carried out in apparatus which, according to the invention, comprises two refining stage vessels, each including a refining chamber, and a slag separation channel, the first refining stage vessel having means for causing molten metal to flow from its slag separation channel to the refining chamber of the second refining stage vessel above the liquid liquid level therein and/or the second refining stage vessel having means for causing slag to flow from its slag separation channel to the refining chamber of the first refining stage vessel above the liquid level therein.

These individual refining stage vessels may be arranged so that the melt can circulate around them from one to the other and back again always flowing in the same sense. The materials flow as follows: The metal and slag flow from the refining chamber of each vessel into its slag separator channel, where they separate from each other. Except in the last stage, the metal is then transferred into the refining chamber of the next refining stage vessel. The separated slag can either be removed from the system, or it can be fed back to the refining chamber of the preceding refining stage vessel if there is one. The slag from the final stage vessel is preferably always fed back again.

The means for causing the molten metal to flow from the first stage vessel to the second stage vessel may consist of a double siphon made of refractory material. This prevents any slag from flowing from a refining stage back into the slag separator channel of the previous refining stage. On the other hand, the flow of metal into the next refining chamber is ensured. Furthermore, in general the amount of refined metal leaving the vessel corresponds to the raw metal entering the vessel, and the rate of flow of slag leaving the vessel is no more than the rate of formation of new slag.

The passage of the refined metal, for example, steel, from one refining stage vessel into the next can be effected without difficulty by positioning the individual stage vessels at different heights, each refining stage vessel being positioned at a lower level than the preceding one, so that the metal flows by gravity. The transference of the slag from one vessel to another where this is done is ensured by the formation of a sufficiently high head of slag in the refining stage vessel.

Alternatively, however, if desired each later refining stage vessel can be positioned at an equal or a higher level than the preceding one. In this case, the metal is transferred from the slag separator channel of the preceding refining stage vessel into the refining chamber of the subsequent stage vessel by a mechanical, electromagnetic, pneumatic or other power operated conveyor, for example, by an electromagnetic pump or by means of pressure applied to the surface of the melt.

The process in accordance with the invention is particularly suitable for use as a two-stage process for refining pig iron high in phosphorous. In this case the slag which leaves the system consists essentially of calcium oxide CaO and silica $SiO_2$ and contains a high concentration of phosphoric acid but only a little ferrous oxide. This slag is removed from the slag separator channel of the first stage vessel. On the other hand, the slag produced in the second stage vessel during the final phosphorous removal, this slag being high in ferrous oxide and low in phosphoric acid, is fed back into the first stage refining chamber for the preliminary refining of the high phosphorous pig iron. This process has considerable advantages compared with the usual LDAC batch process in which the high phosphorous, low ferrous oxide slag produced by the preliminary phosphorous removal during the first blow period is rejected. This slag is poured out of the refining vessel, but there always remain in the vessel considerable slag residues which made the metallurgical conditions for the subsequent refining process, in which phosphorous is finally removed from the partly refined steel, indeterminate, with the result that the process is difficult to control.

In contrast to this, in the process in accordance with the present invention the preliminary refining of the iron, that is to say the first phosphorous removal, is conducted in the first stage refining chamber under a slag which is high in ferrous oxide, FeO, and therefore reactive. From the slag separator channel of the first stage vessel a slag is removed, and rejected from the system which is high in phosphorous and low in ferrous oxide.

It will be appreciated from the above that — contrary to the procedures of the prior art — the molten metal and the slag move through the system as two separate, non-intermingled streams, as distinguished from a slag-metal emulsion.

Considered from a different aspect, the invention relates to method and device for carrying out reactions between liquids, gases, slags and solids, especially for refining pig iron with oxygen and an addition of lime in order to transform to slag or to the gaseous state impurities in the metal and to produce a refined metal such as steel, especially.

To remove the oxidizable iron impurities, pig iron is refined by conventionally adding slag-forming ingredients with oxygen. However, the heretofore known refining methods operate intermittently or discontinuously, i.e. only one pig iron charge is refined at a time.

There has been no dearth in the past of attempts to refine metal continuously. For example, an attempt has been made to refine pig iron discharging from the tap of a blast furnace by injecting oxygen through porous base stones of the iron gutter or trough, or blowing oxygen thereon. Since the flow velocity of the pig iron in the iron channel is relatively high, however, and the reaction surface between the oxygen and the pig iron being refined is limited, this heretofore known process has not thus far proven successful. Also, when using porous gutter or trough stones, a series of difficulties occur, resulting in part from the low level of the pig iron flow, while a large number of lances located one behind the other, are required when oxygen is blown into the channel, and the use of oxygen is very slight.

Further experiments have taken the direction of increasing the reaction surface by finely comminuting the pig iron in order thereby to improve the refining action. Thus, in a known spray refining method, the pig iron stream discharging from the spout of a ladle is sprayed or injected with oxygen which is blown into the pig iron stream by means of a cooled spray ring. The dispersed and pre-refined pig iron then enters a reaction chamber beneath which a receiving vessel is disposed. Separation into the slag phase and into refined metal occurs in the receiving vessel, the refined metal discharging from the bottom of the receiving vessel and accumulating in another ladle. The slag is withdrawn laterally from the receiving vessel through a slag outlet. This method is usable for refining pig iron, however, only if the pig iron is virtually phosphorous-free or the refined steel is to have higher phosphorous content, because a rephosphorization i.e. the absorption of phosphorous through the steel from the slag, occurs in the accumulating vessel.

A further heretofore known method includes conducting the foamed slag containing metal droplets, which is produced when refining pig iron with oxygen, through an overflow from the refining vessel to a second vessel wherein the droplet-shaped steel and the slag are separated from one another by precipitation or settling. In this known method, the foamed slag serves as transport medium for the steel droplets, whereby the reaction period and the quantity of metal transported over the threshold or crest of the overflow are at a specific ratio to one another. It is therefore difficult to achieve specific steel analyses with this known method.

It is accordingly an object according to this aspect of the invention to provide a continuous method and device for carrying out reactions between liquids, gases, slags and solids wherein the time available for the reaction between metal and slag can be adjusted within broad limits and a large reaction surface between metal and slag is simultaneously produced.

To achieve this, a method is provided which comprises passing metal continuously through a layer of slag into an inlet chamber in one columnar portion of a reaction vessel formed with at least two columnar portions, blowing reaction gas onto the surface of the content i.e. the slag or the bath surface or both, of the reaction vessel, and withdrawing refined metal from an outlet chamber in the other columnar portion of the reaction vessel. The metal flowing downwardly in the inlet chamber entrains part of the slag in the form of very small droplets which, due to its lower specific weight, flows upwardly again after a given period of time, while the metal flows further downwardly and passes through an opening into the outlet chamber of the reaction vessel. The length of the reaction path and the reaction period, therewith, are capable of adjustment through the choice of the quantity of onrushing metal per unit time and the kinetic energy thereof.

In accordance with further features of our invention, the metal is allowed to fall freely, out of a ladle disposed above the inlet chamber into the reaction vessel so that, due to its high kinetic energy, it entrains a considerable portion of the slag in the form of very small droplets. Due to the continuous entrainment of slag droplets which again rise into the slag layer later because of the lower specific weight thereof, an exceptionally good intermixture or whirling about of metal and slag occurs. By blowing in or injecting reaction gas, such as oxygen, for example, in the production of steel, and the introduction of solid additives, new slag conducive to the reaction is continuously produced for absorbing the undesired impurities accompanying the metal. The method also may include adding to the metal, scrap of similar metal for cooling purposes, whereby the yield is markedly increased.

We also provide in accordance with our invention, device for carrying out the foregoing method, comprising a reaction vessel having at least two columnar portions, i.e. a U-shaped reaction vessel, for example, with a vertical inlet chamber, a vertical outlet chamber, an opening connecting the chambers, at least one gas-tube communicating with the inlet chamber, and discharge openings for slag and steel contained in the vessel, the discharge openings being vertically spaced from one another.

In accordance with other features of our invention, the reaction vessel of our device is formed of two adjacent chambers separated from one another by a common wall formed with an opening at the base thereof for passage of metal therethrough.

In another embodiment of our device, the reaction vessel comprises two chambers spaced from one another and interconnected by a bridging space.

Other features which are characteristic for the invention are set forth in the appended claims.

Although the invention is illustrated herein as Method and Device for Carrying out Reactions between Liquids, Cases, Slags and Solids, it is nevertheless not intended to be limited to the details shown, since various modifications may be made therein without departing from the spirit of the invention and within the scope and range of equivalents of the claims.

Some example of processes and of apparatus in accordance with the invention will now be described with reference to the accompanying drawings in which FIG. 1 is a plan view of one example of the apparatus in which a two-stage process is carried out;

FIG. 11 is a vertical section of device for carrying out the method of our invention;

FIG. 12 is a top plan view of another embodiment of FIG. 11, wherein the interconnecting bridging space of FIG. 11 is omitted;

FIG. 13 is a vertical section of a modified portion of FIG. 11, namely, the outlet chamber thereof;

FIG. 14 is a vertical section of a further embodiment of the device of our invention;

FIG. 15 is a vertical section of yet another embodiment of the device having special overflow chambers for slag and steel;

FIG. 16 is a modified embodiment of FIG. 15;

FIG. 17 is a vertical sectional view of an embodiment similar to that of FIG. 16 in combination with a refining device; and FIG. 18 is a vertical sectional view of a modified form of the embodiment of FIG. 15 in combination with a refining device.

Similar elements are identified by the same reference numerals in the figures.

All three examples of the apparatus of FIGS. 1–10 include two refining stage vessels *a* and *b* which are connected together in series, both for the flow of molten metal and for the flow of molten slag. In regard to the stream of molten metal the stage *a* is followed by the stage *b*, whereas in regard to the stream of molten slag the stage *b* is followed by the stage *a*.

The vessel *a* consists of a refractory refining chamber 1*a* with an inlet 5 for the feed of molten pig iron, and a cover 7*a* through which a water cooled lance 8*a* for the feed of oxygen projects into the interior of the chamber. The refining chamber 1*a* is connected to a refractory slag separator channel 2*a* equipped with a vent 9*a* for effluent gases, and a drain tapping point 10*a* which is used when it becomes necessary to drain the apparatus entirely. The refining chamber 1*a* also has a similar drain tapping point 10*a*.

The refractory slag separator channel 2*a* has at its downstream end a ceramic slag outlet gutter 11*a* and, leading out from its bottom, an outlet opening 12*a* which serves as an outlet for the molten metal. The metal outlet 12*a* forms part of a siphon system through which molten metal flows out over an overflow weir 4 into a second siphon chamber which is connected by a bottom outlet to a refractory refining chamber 1*b* of the refining vessel *b*. The entire siphon system constitutes a refractory double siphon 3*a* through which molten metal flows from the slag separator channel 2*a* into the refining chamber 1*b* of the second refining vessel *b*. The second refining chamber 1*b* is also equipped with a cover 7*b* through which a water cooled gas lance 8*b* extends for blowing in oxygen. The second refining chamber 1*b* is followed by a slag separator channel 2*b* equipped with a vent 9*b* for effluent gases and a drain tapping point 10*b* for draining the system. The downstream end of the slag separator channel 2*b*, that is to say the end furthest from the refining chamber 1*b* is arranged as a siphon, having in its bottom an outlet opening 12*b* for molten steel, the steel flowing away through this outlet to a refractory steel outlet gutter 13. At a considerable distance above the floor of the slag separator channel 2*b* there is a slag over-flow channel 14 leading into the refining chamber 1*a*.

Figure 1:
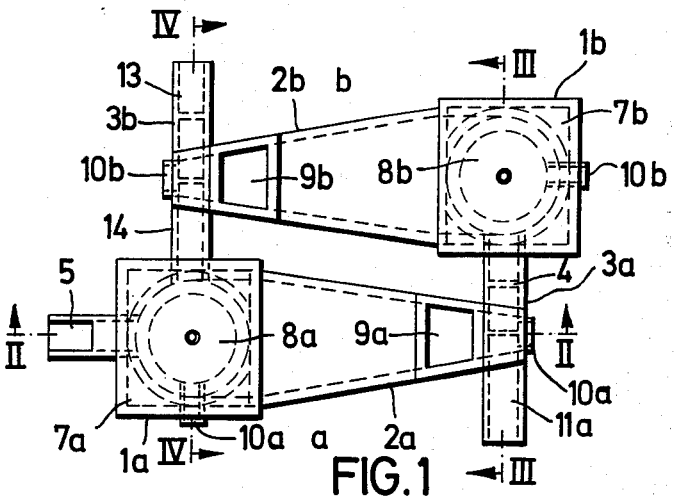
Figure 2:
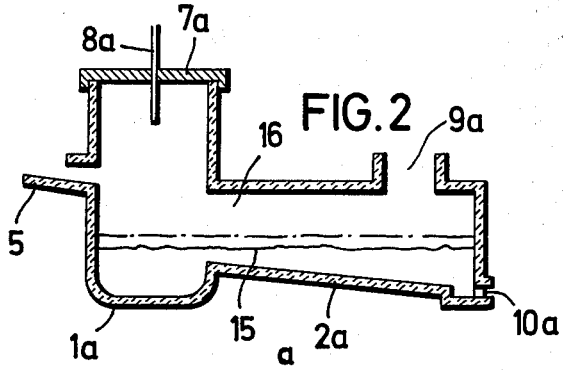
FIG. 2 is a section along the line II—II in FIG. 1.
Figure 3:
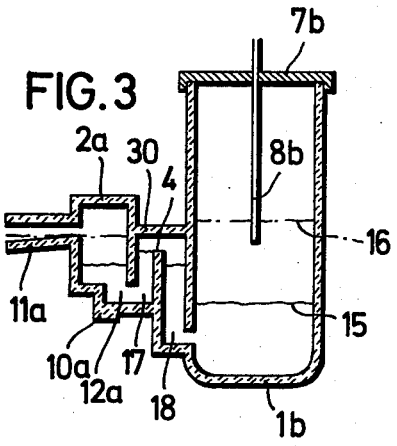
FIG. 3 is a section along the line III—III in FIG. 1.
Figure 4:
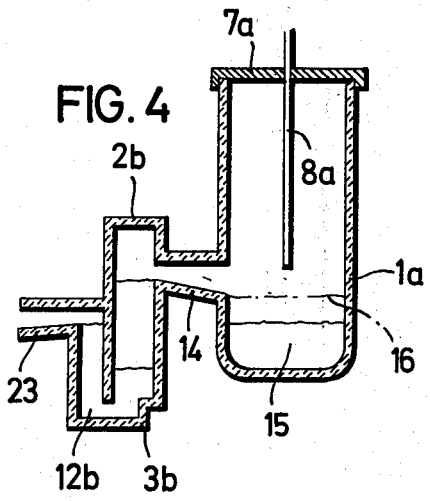
FIG. 4 is a section along the line IV—IV in FIG. 1.

In FIGS. 2 to 4 the surface of the molten metal is indicated by a wavy line 15 and the surface of the molten slag by a chain-dotted line 16. These two lines represent working levels at which the two reacting liquids, the molten metal and the molten slag, remain in the system for their reaction periods corresponding to those which prevail in the usual refining processes. Because the two refining stage vessels *a* and *b* are connected together in the manner of communicating tubes, it follows that the volumes of the two liquids, metal and slag, in the individual stages are kept in the correct relation to each other by the level of the flow of steel passing through the double siphon of the refining stage *a*, and through the siphon of the refining stage *b*, and by the level of the slag in the channels 11*a* and 14. For example during the refining of pig iron containing phosphorous, the molten pig iron is fed at a constant volumetric rate of flow to the refining chamber 1*a*, where it is refined constantly by oxygen, lime dust and if necessary fine ore blown through the lance 8*a*. At the same time a final slag containing ferrous oxide and lime flows constantly from the refining stage *b* over the slag overflow channel 14 into the refining chamber 1*a*, where it reacts to completion and passes through the slag separator channel 2*a* with the stream of metal. The final slag, which has approximately the same composition as the phosphate slag resulting from the first blow period of the LDAC batch process, leaves the slag separator channel 2*a* through the slag outlet gutter 11*a*, whereas the slag-free partly refined iron passes through the submerged passage 12*a* and flows over the overflow weir 4 into the refining chamber 1*b*.

In the second stage refining chamber 1*b* the partly refined iron is finish refined by blowing through the lance 8*b* oxygen containing lime dust and if necessary fine ore. The resulting slag is a highly reactive final slag containing ferrous oxide and lime. This slag has approximately the same composition as the final slag produced during the LDAC batch process at the end of the second blow period. The final slag flows from the slag separator channel 2*b* over the slag overflow channel 14 into the refining chamber 1*a*.

The finish refined steel flows through the submerged passage 12*b* of the siphon 3*b* and out over the delivery overflow weir 13.

In the process according to the invention the rates of flow are determined by the fact that the quantities of metal and slag in the system are constant, these quantities being determined by the double siphon 3*a* and the level of the gutter 11*a*. The first stage vessel *a* is situated higher than the second stage vessel *b*, and consequently there is a height difference between the metal surfaces 15 in the two neighbouring chambers 17 and 18 of the double siphon, with the result that molten pig iron flows from the vessel *a* into the vessel *b* at a rate corresponding to the rate of feed of pig iron through the feed inlet 5. Assuming that all operating conditions remain constant the process yields a steel very constant in composition and quality.

A particular advantage of the apparatus in accordance with the invention is that the refining chambers 1*a* and 1*b*, the slag separator channels 2*a* and 2*b*, and the two siphon chambers 17 and 18 can all be constructed as independent structural units, which can be independently replaced when worn out.

Figure 5:
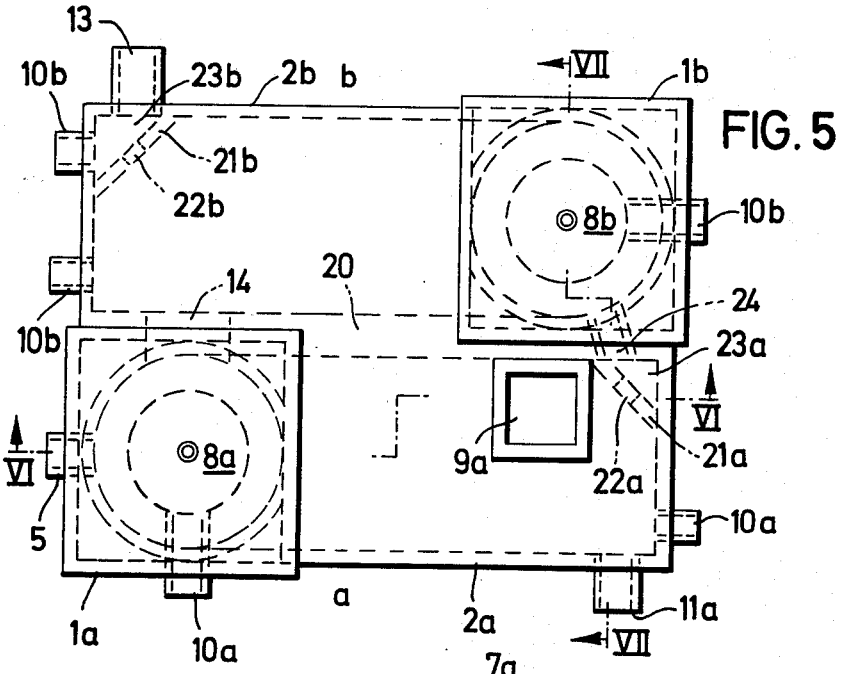
FIG. 5 is a plan view of a second example of the apparatus again in which a two-stage process is carried out.
Figure 6:
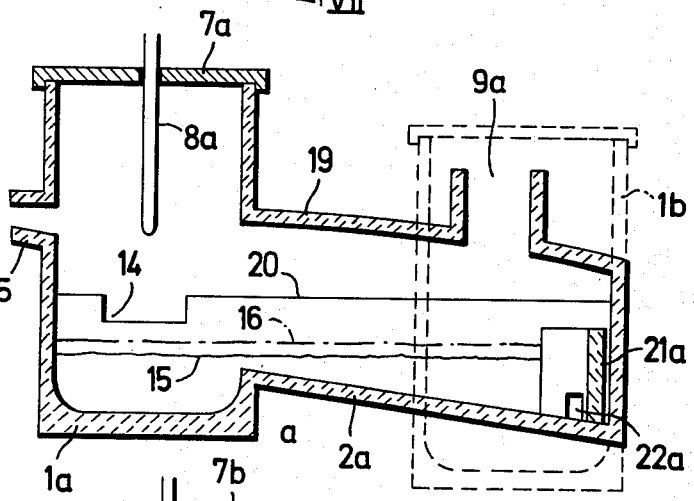
FIG. 6 is a section along the line VI—VI in FIG. 5.
Figure 7:
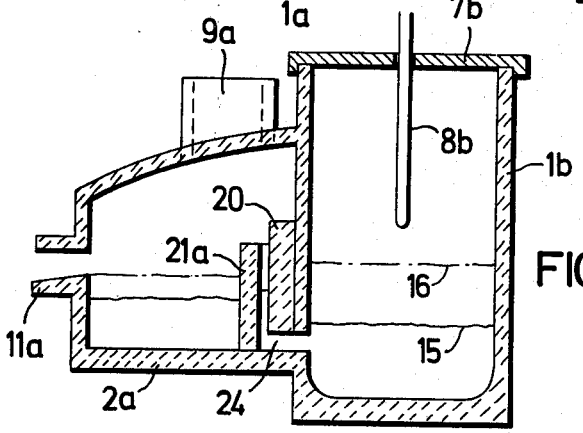
FIG. 7 is a section along the line VII—VII in FIG. 5.

The apparatus shown in FIGS. 5 to 7 is essentially similar in construction as that shown in FIGS. 1 to 4. Corresponding parts have been given the same index numbers. The main difference in the example of FIGS. 5 to 7, is that the two refining stage vessels *a* and *b* are both covered over by a common brick vault 19. The two slag separator channels are separated from each other by a common separating wall 20. In front of this wall 20 there is a further separating wall 21 which contains a submerged passage 22 for the partly refined steel. Between these two walls 20 and 21 there is a balancing chamber 23, from which the partly refined steel flows through a submerged passage 24 into the refining chamber 1*b*. The common brick vault 19 allows the effluent gases to flow from the second stage vessel *b* over the slag overflow weir 14 into the refining chamber 1*a* and from here the gases escape through the slag separator channel 2*a* and through the effluent gas vent 9*a*.

Figure 8:
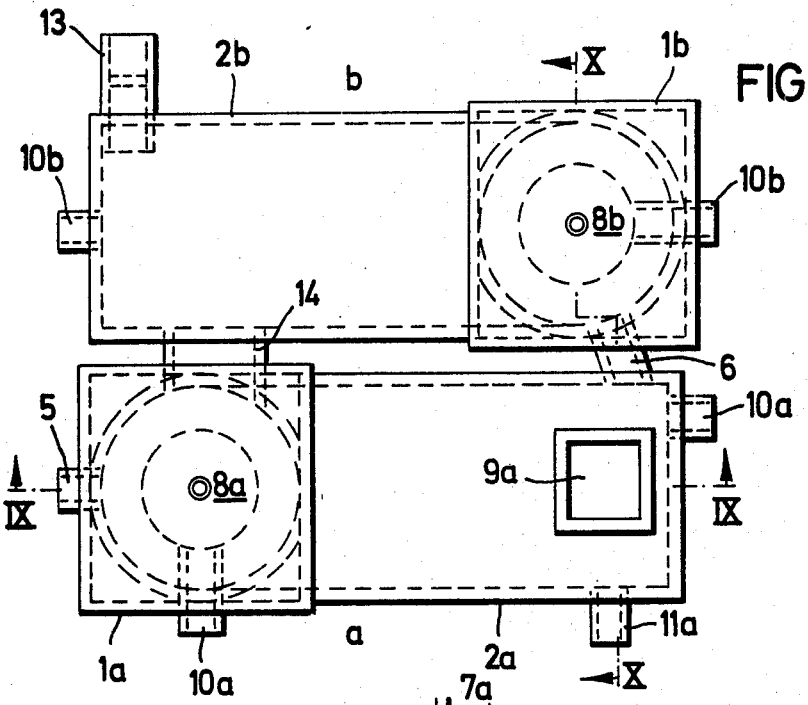
FIG. 8 is a plan view of a third example of the apparatus for carrying out a two-stage process.
Figure 9:
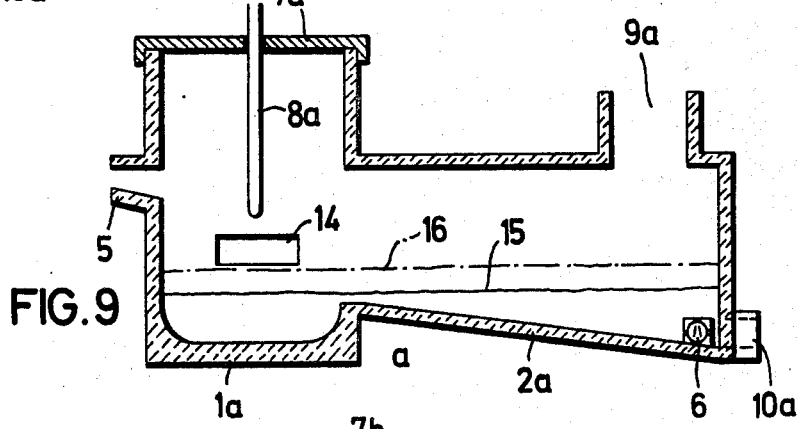
FIG. 9 is a section along the line IX—IX in FIG. 8.
Figure 10:
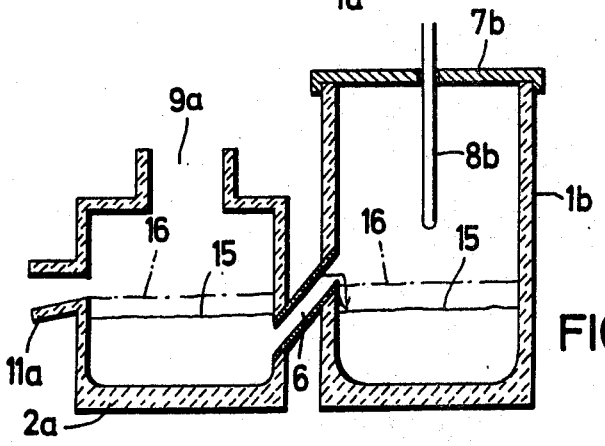
FIG. 10 is a section along the line X—X in FIG. 8.

The apparatus shown in FIGS. 8 to 10 has a similar arrangement for the supply and venting of gases. This apparatus consists, as does the apparatus of FIGS. 1 to 4, of two refining stage vessels. However in this example the two stages are connected together by a steel melt conveyor 6 of a known kind, for example an electro-magnetic pump. In this example the liquid levels 15 and 16 of the metal and slag are detemined, amongst other things, by the rate of feed of the iron and by the rate of throughput of the conveyor device 6. The liquid levels in the two refining stage vessels *a* and *b* can be adjusted independently.

All the examples have this in common, that the rates of flow of slag and iron or steel can be adjusted independently of the reaction times. In this way a product steel of very constant analysis is obtained by a process which operates very economically.

Turning now to FIG. 11, there is shown a reaction vessel 110 which includes an inlet chamber 111, an addition chamber 112 and an outlet chamber 113 all of which are interconnected by a bridging space 114 in the manner of communicating tubes. Lances 115 and 116 for supplying reaction gas communicate respectively with the inlet chamber 111 and the outlet chamber 113. Slag gutters or troughs 117 and 118 extend from the inlet chamber 111 and the outlet chamber 113, respectively, at levels thereof suitable for discharging slag therefrom. The outlet chamber 113 furthermore is provided with a discharge gutter or trough 119 for the processed metal. A ladle (not shown) can be located beneath the open end of the discharge trough 119 for receiving therein refined metal from the vessel 110, or another reaction vessel similar to the vessel 110, for example, can be located beneath the outlet end of the discharge trough 119. The reaction vessel can also be formed of two chambers 111 and 113 located adjacent one another and separated only by a partition or wall 122 provided with a flow-through opening 121, as shown in FIG. 12. Both the embodiments of FIGS. 11 and 12 are provided with a guide member 123 at the base of the inlet chamber 111 for controlling the flow direction of the liquid metal in the chamber 111.

The molten pig iron is supplied in a closed stream 125 into the inlet chamber 111 of the reaction vessel 110 from a ladle 124 disposed above the inlet chamber 111. In accordance with the physical principles applying to communicating tubes, the various vertical columnar portions of the reaction vessel 110 are filled with metal 126, and the chambers 111 and 113 contain a surface layer of slag. Oxygen injected or blown into the chambers 111 and 113 through the tubes or lances 115 and 116 refines the pig iron, a primary slag 127 being formed from the impurities in the pig iron and from the additives supplied to the melt. The primary slag 127 is discharged from the reaction vessel through the slag trough 117. Refined iron or steel discharges from the outlet chamber 113 through the trough 119 in the same proportion as fresh molten pig iron is supplied to the inlet chamber 111, while a secondary slag 128 forming above the metal melt in the outlet chamber 113 discharges through the slag opening 118 when the level of the secondary slag layer 128 is at a suitable elevation. Scrap chunks 129 of similar metal as that of the metal 126 in the vessel 110 can be supplied thereto through the addition chamber 112 for cooling the molten metal 126. The required additives for forming slag are supplied with the oxygen stream, i.e. through the tubes or lances 115 and 116 or by being directly placed in the chambers 111 and 113.

The pig iron being poured into the inlet chamber 125 and already present therein is whirled about by the oxygen stream supplied through the lance 115, is intermixed with the slag 27 and then flows downwardly, entraining part of the slag therewith. By raising and lowering the pig iron ladle 124, the duration of the entrained slag droplets in the melt 126, and consequently the reaction time for the iron and slag, can be varied. The guide member 123 located at the base of the inlet chamber 111 diverts the downwardly sinking iron initially in direction toward the lefthand wall of the chamber 111 as shown in FIGS. 11 and 12. The melt rises along the left-hand wall of the chamber 111 until it reaches the level of the right-hand wall of the chamber 111, as shown in FIG. 11, passing finally through the bridging space or chamber 114 (FIG. 11) or the opening 121 (FIG. 12) into the outlet chamber 113. Considerable improvement in the utilization of the fresh oxygen is afforded if the secondary slag 128 is conducted out of the outlet chamber 113 into the inlet chamber 111 in the manner shown in the various embodiments and modifications of FIGS. 13 to 18 of the drawings. The secondary slag 128, which is still reactive, then comes into contact and reacts with the iron flowing into the respective inlet chambers 111 and finally discharges from the inlet chambers through the slag trough 117. As shown in FIGS. 13 to 18, the secondary slag 128 flows through an inclined slag channel 131 under the effect of gravity into the inlet chamber 111. This is possible, however, only if the level of the slag layer 128 in the outlet chamber 113 is higher than the level of the slag layer 127 in the inlet chamber 111. In that respect, the slag overflow is determined by the ferrostatic equilibrium of the chambers 111 and 113. In order to be independent therefrom, the cross-section of the outlet chamber 113 can be considerably narrowed on the one hand in the upper slag-receiving portion thereof. It is simpler, however, if the ferrostatic equilibrium is shifted, for example, under the influence of an electromagnetic field or a vacuum, so that the level of the melt and of the slag is located higher in the outlet chamber 113 than in the inlet chamber 111. For this purpose, the bridging space 114 or the outlet chamber 113 is surrounded by an electromagnetic coil, as in FIG. 14. In this case, the bridging space 113 can have a smaller width than that of the chambers 111 and 113.

A further possibility is to close the outlet chamber 113 with a cover 138 as shown in the embodiments of FIGS. 15 and 18, and to divide the outlet chamber 113 into two separate subchambers 139 and 140 by means of a partition 133 and connect the subchamber 139 to a vacuum pump 134 so that, due to the low or negative pressure thereby produced in the subchamber 139, the level of the melt and the slag can be raised until the slag 128 reaches the inlet opening 135 of the slag channel 131. Raising of the slag layer on the melt present in the outlet chamber 113 is capable of being effected by injecting or blowing gas into the slag or the melt or into both of them. The consequent foaming of the slag or metal or both produces a reduction in the specific weight thereof, so that in accordance with the principles applicable to communicating tubes, the level of the metal and slag columns in the outlet chamber 113 is raised. The injection or in-blowing of a gas or the foaming of the slag can remain limited to the space 140 located in the vicinity of the opening 135 to the slag channel 131. Hot gases are preferably employed for foaming the slag, metal or both, the gases being capable of being removed by suction from the outlet chamber 113 or the inlet chamber 111. A slag overflow is attainable by metering the gas stream flowing from the lances 116 so that the employment of a vacuum or the injection of hot gas is not required. Furthermore, the slag channel 131 can be of U-shaped construction, and a hot gas can be blown into the leg of the U-shaped structure leading to the inlet chamber 111, thereby producing a flow of slag in direction toward the inlet chamber 111.

In the embodiment shown in FIG. 14, the kinetic energy of the pig iron stream 125 is employed for attaining a higher melt and slag level in the outlet chamber 113 than in the inlet chamber 111. Part of the kinetic energy of the pig iron stream 125 is spent in effecting turbulence in the inlet chamber 111. When the pig iron stream with entrained slag particles impinges on the surface of the guide member 123 facing toward the left-hand side of FIG. 14, it is diverted toward the left-hand side of FIG. 14 and upwardly as indicated by the related arrows. In the upper part of the inlet chamber 111, the gas stream from the lance 115 meets this upward flow of pig iron and entrained slag particles and forces it to take a direction toward the bridging space 114 as shown by the associated arrows in FIG. 14. Then, the flow velocity above the apex of the guide member 123 is increased due to the downwardly flowing metal of the pig iron stream 125. The flow velocity in the bridging space 114 is determined by the cross-section thereof, as long as no electromagnetic field is employed. The flow velocity is further reduced especially at the foot of the outlet chamber 113 by enlarging the cross-section thereof at 137. The kinetic energy of the flowing metal then converts to pressure so that in deviation from ferrostatic equilibrium, the level of the melt and slag in the outlet chamber 113 is capable of being adjusted higher than in the inlet chamber 111. Also in this case, the slag 128 flows into the inlet chamber 111 by gravity action.

In addition to the kinetic energy of the metal stream, the flow energy of the vortex flows produced, as known, by the injection of the gas stream and running in vertical direction is also utilized. For this purpose, the inlet and outlet cross-section of the bridging space 114 is so shaped that in the vicinity of the transition from the inlet chamber 111 to the bridging space 114, a stagnation zone is formed, and in the vicinity of the transition from the bridging space 114 to the outlet chamber 113, a wake or suction is formed. In this manner, also, an increase in the height of the metal or slag column in the outlet chamber 113 can be attained.

A variation of modification is possible in that the inlet stream 125 of the metal can be shifted relative to the location of the gas stream from the lance 115 or with respect to the location of the guide member 123. When the inlet stream 125 is shifted toward the right-hand side of FIG. 14, an ever increasing portion of the metal reaches the bridging space 114 directly, without being directly engaged by the gas stream after the reaction thereof with the slag 127, and this portion of the metal is intermixed with the metal in the bridging space 114 which, according to the manner shown in FIG. 4, has already been circulated. A similar effect is attainable if the processing vessel 110 is placed on a see-saw while the inlet stream 125 is held in a fixed position, and then the inlet chamber is lowered with the see-saw. The inventive method can be carried out, furthermore, by closing the outlet chamber 113 with the aforementioned cover 138, as shown in FIGS. 15 to 18, and subdivided by a partition 133, the outlet chamber 113 being moreover in communication through an opening 141 with an adjacent chamber 142 from which there extends drain trough or gutter 119 for the metal. If the space 139 in the outlet chamber 113 is maintained at superpressure by means of the reaction gas introduced by the lance 116 or any other gas, the slag 128 and the metal 126 are then compressed, in accordance with the amount of super-pressure or excess pressure, into the slag subchamber 140 and into the adjacent chamber 142 which are only under atmospheric pressure. In this way, both the slag overflow and the metal discharge can be regulated. The excess pressure in the chamber space 139, is adjusted by a valve 143 which can be located either in the cover 138, as shown in FIG. 15, or in a connecting line 144 between the outlet chamber 113 and the inlet chamber 111, as shown in FIGS. 16 to 18. In the latter case, the waste gas passes through the connecting line 144 into the inlet chamber 111.

An especially simple solution is provided if the inlet and outlet chambers 111 and 113 are located directly adjacent one another, as in FIG. 12, and are separated from one another by a partition or wall 122 having an opening 121 at the lower end thereof for providing communication between the chambers 111 and 113. If an inclined channel is located in the partition and extends from the vicinity of the boundary surface between metal and slag in the outlet chamber 113 to the upper part of the inlet chamber 111, such a channel can replace the slag chamber 140 or the partition 133 thereof. Due to the superpressure in the outlet chamber 113, the slag in the inclined connecting channel would be subjected to pressure so that it would flow into the inlet chamber 111.

The method of our invention is also capable of being practiced in combination with other methods. Thus, for example, the metal stream 125 can be sprayed with a gas and oxidized when it enters the inlet chamber 111. In such case, only an after-treatment or post-reaction of the previously refined iron takes place in the inlet chamber 111. This combined process can be carried out by passing the gas out of the outlet chamber 113 and conducting it through a line 145 into a ring 146 from which it discharges through suitable nozzle openings, for example, to comminute or scatter the metal stream 125, as shown in FIG. 17. The gas can also be conducted from the outlet chamber 113, however, through a line 149 into a preferably ceramic tube 147 (FIG. 18) constructed as a type of injector or jet pump. A low or negative pressure is produced in the narrowest cross section of the tube 147, sucks the slag out of the outlet chamber 128 and forces it in a direction toward the inlet chamber 111. The distributor ring 148 then produces an intermixing of the foamed slag 127 and the metal stream 125.

The vessel 110 of our invention has a lining of fire-resistant material or is formed of water-cooled walls, for example, of iron or copper. With correct adjustment of the cooling system, represented diagrammatically by the tube 150, the inner surfaces of the vessel walls can be maintained at a temperature below the melting point of the metal. As a consequence thereof, solidification of the metal is caused in a boundary layer at the vessel walls. By varying the cooling action from the system 150, the thickness of this solidified protective layer of metal can be matched or accommodated to the respective conditions. Furthermore, by varying the temperature and quantity of the coolant per unit time, the cross-section of the vessel can be increased and decreased at specific locations, so as to control thereby the flow velocity and direction of the metal. In each case, as shown in FIGS. 17 and 18, effective protection of the vessel walls against attack by the slag, the metal or both, is afforded.

What is claimed is:

1. In a process of continuously refining molten metal in a refining apparatus having communicating first and second refining stage spaces, wherein refining gas is blown into the molten metal in the presence of a slag layer on the molten metal, the improvement which comprises conveying the molten metal and the slag as two separate non-intermingled streams through said refining stage spaces, as distinguished from a slag-metal emulsion, causing slag in said second refining stage space continuously to flow back into said first refining stage space to form a slag layer on the molten metal in said first refining stage space, blowing refining gas into said molten metal in said first refining stage space below said slag layer, conveying the molten metal from said first refining stage space to said second refining stage space while preventing the flow of slag from said refining stage space to said second refining stage space, blowing refining gas onto said molten metal in said second refining stage space in the presence of slag and separating the molten metal and the slag from each other after the molten metal has passed through said second refining stage space.

2. In a process of continuously refining molten metal in a refining apparatus having communicating first and second refining stage vessels, wherein refining gas containing slag-forming substances therein is blown into the molten metal and slag is thus formed on top of the molten metal, the improvement which comprises conveying the molten metal and the slag as two separate non-intermingled streams through said refining stage vessels as distinguished from a slag-metal emulsion, causing the slag which is formed in said second refining stage vessel continuously to flow back into said first refining stage vessel to form a slag layer on the molten metal in said first refining stage vessel, blowing refining gas into said molten metal in said first refining stage vessel below said layer, conveying the molten metal from said first refining stage vessel to said second refining stage vessel while preventing the flow of slag from said first refining stage vessel to said second refining stage vessel, blowing refining gas containing slag-forming substances into said molten metal in said second refining stage vessel to form a fresh slag layer on the molten metal in said second refining stage vessel and separating the molten metal and the slag from each other after the molten metal has passed through said second refining stage vessel.

3. The improvement of claim 2, wherein said refining gas which is blown in said first refining stage is devoid of any slag-forming additives.

4. In a process of continuously refining molten metal in a refining apparatus having communicating first and second refining stage vessel, wherein refining gas containing slag-forming substances therein is blown into the molten metal and slag is thus formed on top of the molten metal, the improvement which comprises conveying the molten metal and the slag as two separate laminar, non-intermingled streams through said refining stage vessels as distinguished from a slag-metal emulsion, causing the slag which is formed in said second refining stage vessel to build up a pressure head so as to enable the slag continuously to flow back by gravity into said first refining stage vessel to form a slag layer on the molten metal in said first refining stage vessel, blowing refining gas into said molten metal in said first refining stage vessel below said slag layer, conveying the molten metal from said first refining stage vessel to said second refining stage vessel while preventing the flow of slag from said first refining stage vessel to said second refining stage vessel, blowing refining gas containing slag-forming substances into said molten metal in said second refining stage vessel to form a fresh slag layer on the molten metal in said second refining stage vessel and separating the molten metal and the slag from each other after the molten metal has passed through said second refining stage vessel.

5. Method of continuously refining pig iron with oxygen and an addition of lime, which comprises passing liquid metal continuously through a layer of slag of given composition into an inlet chamber in a first columnar portion of a reaction vessel formed with at least two columnar portions, blowing reaction gas onto the surface of the content of the reaction vessel, withdrawing refined metal below a slag layer from an outlet chamber in a second columnar portion of the reaction vessel, and passing directly by gravity feed at least partially said layer of slag overlying the refined metal in the outlet chamber to the first columnar portion of the reaction vessel, said liquid metal and said slag being conveyed through said reaction vessel as two separate, non-intermingled streams, as distinguished from a slag-metal emulsion.

6. Method according to claim 5, which includes feeding the metal in free fall from a ladle located above the inlet chamber into the reaction vessel.

7. Method according to claim 5, which includes supplying solid additives to the metal.

8. Method according to claim 7, wherein the solid additive is scrap metal.

9. Method according to claim 5, which includes blowing a gas into the metal through a slag layer located above the metal in the outlet chamber.

10. Method according to claim 9, which includes applying vacuum in the outlet chamber so as to raise the level of the metal and slag therein.

11. Method according to claim 5, which includes additionally blowing gas into the metal received in a lower part of the outlet chamber.

12. Method according to claim 5, which includes additionally blowing gas into the slag in the outlet chamber.

13. Method according to claim 5, wherein the metal is ferromagnetic, and which includes applying an electromagnetic field to the metal so as to raise the level thereof in the outlet chamber.

14. Method according to claim 5, which includes applying superpressure for selectively forcing the slag and the metal out of the outlet chamber.

15. Method according to claim 5, wherein a layer of slag is located above the metal in the outlet chamber, and which includes passing the slag with the reaction gas out of the outlet chamber into a reaction chamber of the vessel.

16. Method according to claim 5, which includes applying turbulence to the metal in the lower part of the inlet chamber.

17. Method according to claim 5, which includes forming a stagnation region at an outlet opening of the inlet chamber and a wake at an inlet opening to the outlet chamber.

18. Method according to claim 5, which includes intensively cooling the vessel walls so as to form a solid layer of the metal thereat.

19. Method according to claim 5, wherein the metal is pig iron and the reaction gas is oxygen.

* * * * *

UNITED STATES PATENT OFFICE

CERTIFICATE OF CORRECTION

Patent No. 3,985,549 Dated October 12, 1976

Inventor(s) Paul Rheinländer et al

It is certified that error appears in the above-identified patent and that said Letters Patent are hereby corrected as shown below:

In the heading of the Patent [30] should read as follows:

--[30] Foreign Application Priority Data

| | | |
|---|---|---|
| May 18, 1968 | Germany | 1758364 |
| June 22,1968 | Germany | 1758537 |
| June 18,1969 | Germany | 1930746--. |

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*